United States Patent [19]

Crystal et al.

[11] Patent Number: 4,686,900

[45] Date of Patent: Aug. 18, 1987

[54] IMPACT PRINTER WITH APPLICATION OF OBLIQUE PRINT FORCE

[75] Inventors: Richard G. Crystal, Los Altos; Andrew Gabor, Alamo, both of Calif.

[73] Assignee: Xerox Corporation, Stamford, Conn.

[21] Appl. No.: 804,955

[22] Filed: Dec. 5, 1985

[51] Int. Cl.[4] ..... B41J 9/00; B41J 1/30

[52] U.S. Cl. ..... 101/93.48; 400/144.2; 400/157.2

[58] Field of Search ..... 101/93.29, 93.48; 400/144, 144.1, 144.2, 144.3, 144.4, 157.2

[56] References Cited

U.S. PATENT DOCUMENTS

| | | | |
|---|---|---|---|
| 4,026,403 | 5/1977 | Inose et al. | 400/144.2 |
| 4,147,438 | 4/1979 | Sandrome et al. | 400/144.2 |
| 4,319,849 | 3/1982 | Dollenmayer | 101/93.48 |
| 4,324,497 | 4/1982 | Gabor | 101/93.48 |
| 4,389,129 | 6/1983 | Sugiura | 400/144.2 |
| 4,423,971 | 1/1984 | Hira et al. | 400/144.2 |
| 4,464,071 | 8/1984 | Sakakibara | 400/144.2 |

FOREIGN PATENT DOCUMENTS

| | | | |
|---|---|---|---|
| 33151 | 2/1984 | Japan | 400/144.2 |

OTHER PUBLICATIONS

Freeman et al.; "Print Hammer Position Sensor"; *IBM Tech. Disc. Bull.;* vol. 18, No. 12, 4072; May 1976.

*Primary Examiner*—Edgar S. Burr
*Assistant Examiner*—David A. Wiecking
*Attorney, Agent, or Firm*—Serge Abend

[57] ABSTRACT

A serial impact printer including a novel hammer mechanism for applying a printing force against a character element to drive it in sequence against a marking medium, a mark receiving support, such as a sheet of paper, and the print line on a platen. The hammer mechanism delivers its impact force against a character element along a line forming an angle with a line normal to the surface of the platen at the point of contact of the character element with the platen. This arrangement enhances the ink release of single strike ribbons and multi-part carbon forms. By urging the hammer mechanism against the character element for an extended dwell time of at least 1 millisecond, which is substantially greater than that in conventional printers, the ink release of multi-strike ribbons, fabric ribbons and correctable ribbonsd may also be enhanced. By incorporating both the oblique impact and the extended dwell, the ink release characteristics of all conventional ribbons and multi-part forms will be enhanced.

8 Claims, 5 Drawing Figures

IMPACT PRINTER WITH APPLICATION OF OBLIQUE PRINT FORCE

This application relates to an improved serial impact printer and, more particularly, to a novel printer designed to substantially reduce impact noise generation during the printing operation. The design enables improved ink release from all common ribbon types and multi-part forms at lower print forces, and enhances print point visibility.

BACKGROUND OF THE INVENTION

The office environment has, for many years, been the home of objectionable noise generators, namely, typewriters and high speed impact printers. Where several such devices are placed together in a single room, the cumulative noise pollution may even be hazardous to the health and well being of its occupants. The situation is well recognized and has been addressed by the technical community as well as by governmental bodies. Attempts have been made to reduce the noise by several methods: enclosing impact printers in sound attenuating covers; designing impact printers in which the impact noise is reduced; and designing quieter printers based on non-impact technologies such as ink jet and thermal transfer. Also, legislative and regulatory bodies have set standards for maximum acceptable noise levels in office environments.

Loudness levels measured on a dBA scale represent human perceived levels of loudness as opposed to absolute values of sound intensity. When considering sound energy represented in dBA (or dB) units, it should be borne in mind that the scale is logarithmic and that a 10 dB difference means a factor of 10, a 20 dB difference means a factor of 100, 30 dB a factor of 1000 and so on. Typically, conventional impact printers generate an average noise in the range of 70 to just over 80 dBA, which is deemed to be intrusive. When reduced to the 60–70 dBA range, the noise is construed to be objectionable. Further reduction of the impact noise level to the 50–60 dBA range would improve the designation to annoying. Clearly, it would be desirable to reduce the impact noise to a dBA value in the low to mid-40's, a very aggressive dropoff in printer impact noise.

The printing noise referenced above is of an impulse character and is primarily produced as the hammer impacts and drives the type character pad against the ribbon, the print sheet and the platen with sufficient force to release the ink from the ribbon. The discussion herein will be directed solely to the impact noise which masks other noises in the system. However, once the impact noise has been substantially reduced, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

Since it is the impact noise which is modified in the present invention, it is necessary to understand the origin of the impact noise in conventional ballistic hammer impact printers. In a typical daisywheel printer, a hammer mass of about 2.5 grams is driven ballistically by a solenoid-actuated clapper; the hammer hits the rear surface of the character pad and impacts it against the ribbon/paper/platen combination, from which it rebounds to its home position where it must be stopped, usually by another impact. This series of impacts is the main source of the objectionable noise.

In conventional printers, the total dwell time of the platen deformation impact, i.e. the hammer against the ribbon/paper/platen combination, is typically in the vicinity of 100 microseconds. Yet, at a printing speed of 30 characters per second, the mean time available between character impacts is about 30 milliseconds. Clearly, there is ample opportunity to significantly stretch the impact dwell time to a substantially larger fraction of the printing cycle than is typical of conventional printers. For instance, if the dwell time were stretched from 100 microseconds to 6 to 10 milliseconds, this would represent a sixty- to one hundred-fold increase, or stretch in pulse width relative to the conventional. By extending the deforming of the platen over a longer period of time, an attendant reduction in noise output can be achieved as is fully explained in the "Theory of Operation" section of the copending application assigned to the same assignee as the present case and bearing U.S. Ser. No. 751,169 filed July 2, 1985 in the name of Andrew Gabor and entitled "Quiet Impact Printer." The copending application is incorporated herein by reference.

The operator is provided with a number of ribbon materials for use in today's printers. Each ribbon type is formulated for a particular purpose and has its own ink release characteristics, but all are designed for use in the conventional high force, low mass, short dwell time printers. Conceivably, a printer manufacturer can manufacture and designate ribbon types and formulations having release characteristics tailored to be particularly compatible with his printer. However, it would be desirable if the presently commercially available ribbon types could be used in the low mass, long dwell time printer of the present invention and exhibit comparable or improved print quality. The real challenge in printer design is its ability to obtain high print quality on different types of multi-part forms. Whereas the printer manufacturer may designate particular ribbons to be used with his printer, the customer chooses his multi-part forms independently of the printer.

A brief discussion of the conventional ribbon types and multi-part forms, and their characteristics will aid in an understanding of the improved release mechanisms to be described below. "Single strike" ribbons comprise a layer of a dry waxy ink substance on a polyethylene substrate. When struck by a print element, propelled by a hammer, the wax fractures in the character configuration, is broken away from its substrate and is completely transferred to and adheres to the image receptor sheet. This process actually comprises fracturing and pushing out a character shaped plug. Multi-part forms with interleaved carbons have the same ink release mechanism since the carbon sheets comprise a similar waxy substance coated on a low grade paper. On the other hand, multi-part forms with encapsulated inks mark the paper sheet when the capsules are broken and their liquid contents react with the coating on the sheet to form a colored image.

"Multi-strike" ribbons may be reviewed as microstamp pads, or a thin porous sponge filled with ink, supported upon a polyester substrate, such as that commonly known as Mylar. This substrate material is strong enough to withstand plural impacts on very closely overlapping areas. "Fabric" ribbons are similar to multistrike but comprise a cloth substrate whose fibers are impregnated with a liquid ink.

"Correctable" inks are characterized by being able to be lifted off the paper shortly after printing. The ink is carbon (or other colorant) in a friable plastic on a polyethylene substrate. A description of this type of ribbon is to be found in U.S. Pat. No. 3,825,470 entitled "Adhesively Eradicable Transfer Medium" (D. L. Elbert et al). The coating is easily fractured on impact and is pressure sintered into a cohesive character shaped mass on the paper image receptor. Since the mass is a plastic, it doesn't penetrate deeply into the paper fibers. Thus, during correcting, an adhesive tape is used to attach to the cohesive mass and pull it off the paper. Given enough time, about five minutes, the plastic particles will eventually flow into the paper to form a permanent image.

It has been determined that the single strike ribbon and multi-part carbon forms will have improved release if a shear component, i.e. tangent to the platen, is added to the impact force. This component will induce a "peeling" action as the substrate is shifted by the character element while the ink "plug" is held stationary on the paper. Clearly, the shear component will have absolutely no advantageous effect on the ink release of the multistrike or fabric ribbons which are in effect microsponges. Pressure alone will squeeze the liquid ink out of the pores, the direction of the pressure is of little or no consequences. Similarly the correctible ribbon does not respond to shear.

Whereas, the multi-strike, fabric and correctable ribbons will not respond to shear forces, they will respond favorably to an extended application of pressure. It is well known that the longer one applies pressure to a sponge the more fluid will be released. On the other hand, the ink release of single strike ribbons and multipart interleaved carbon forms will not be improved by the extended dwell. Once sufficient force has been applied to fracture the solid ink coating it is transferred to the paper. Further application of force will not fracture it further. Therefore, extended dwell is irrelevant to these marking materials.

It is the primary object of the present invention to provide a printer which will operate several orders of magnitude quieter than printers typical in today's marketplace, while obtaining the same print quality, regardless of the type of ribbon or multi-part form used therein.

SUMMARY OF THE INVENTION

To that end, the present invention may be carried out, in one form, by providing a serial impact printer in which a printing force is delivered to drive a character element in sequence against a marking medium, a mark receiving support, such as a sheet of paper, and the print line on a platen. The printing force is delivered by an impacting element which is moved against the character element along a line forming an angle with a line normal to the platen at the point of contact of the character element with the platen. This form of the invention adds shear to the impact and enhances the ink release of single strike ribbons and multi-part carbon forms. This invention also contemplates the desirability of moving the impacting element against the character element and urging the character element against the platen for an extended dwell time of at least 1 millisecond, which is substantially greater than that in conventional printers. This form of the invention enhances the ink release of multistrike ribbons, fabric ribbons and correctable ribbons. By incorporating both the oblique impact and the extended dwell, the ink release characteristics of all conventional ribbons will be enhanced.

BRIEF DESCRIPTION OF THE DRAWINGS

The advantages of the present invention will be understood by those skilled in the art through the following detailed description when taken in conjunction with the accompanying drawings, in which.

DETAILED DESCRIPTION OF THE ILLUSTRATED EMBODIMENT

Figure 1:
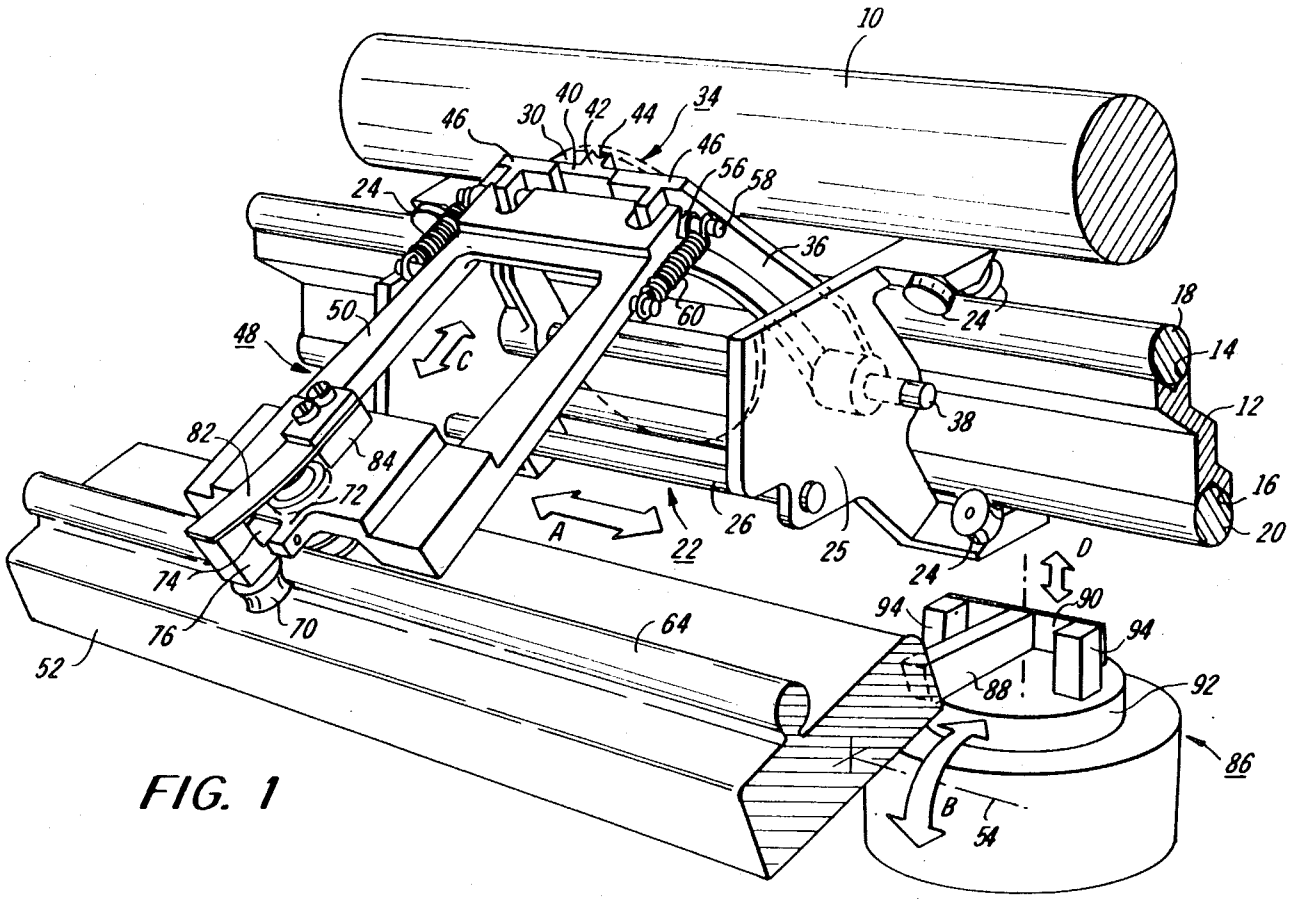
FIG. 1 is a perspective view of the novel impact printer of the present invention.
Figure 2:
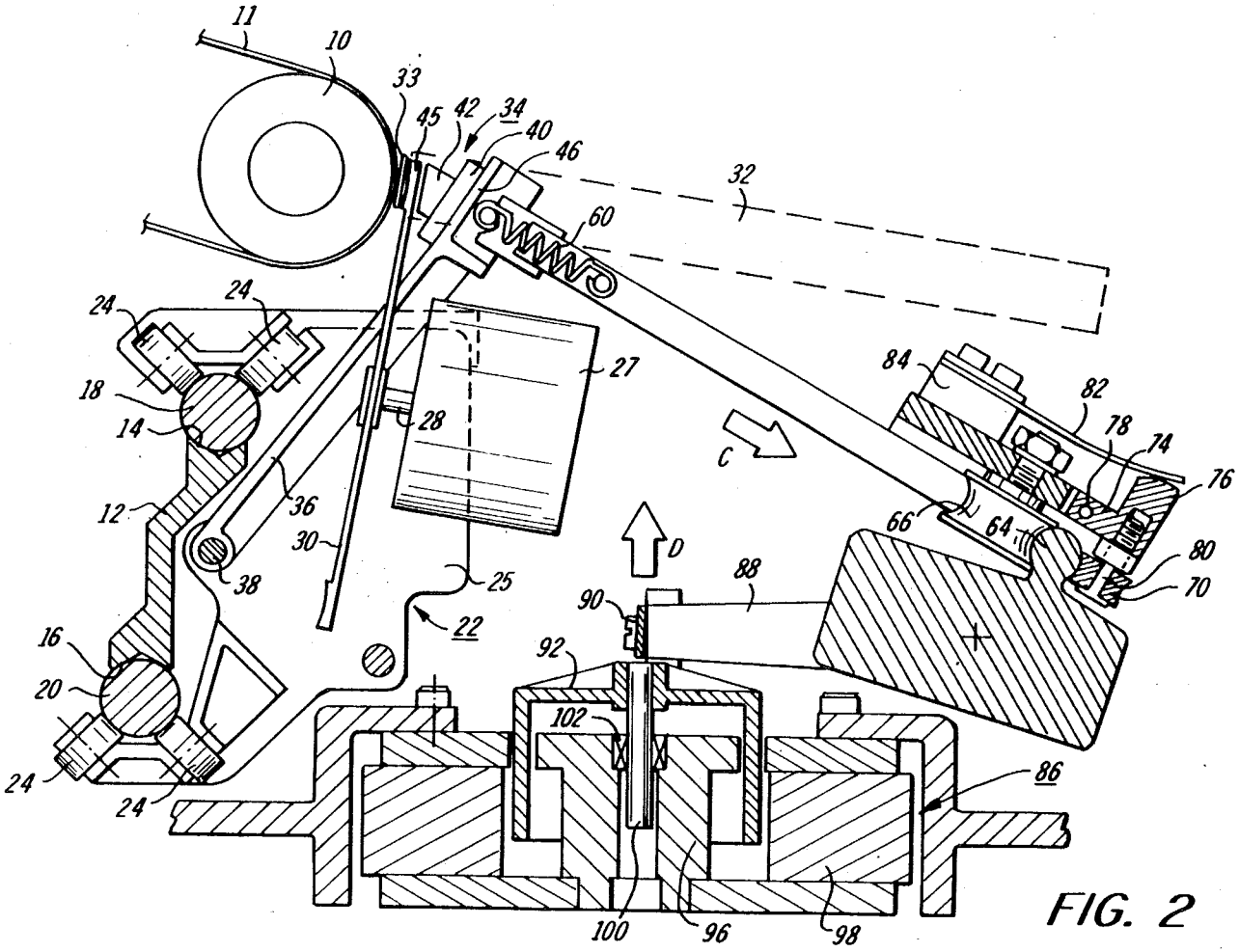
FIG. 2 is a side elevation view of the novel impact printer of the present invention showing the print tip spaced from the platen.
Figure 3:
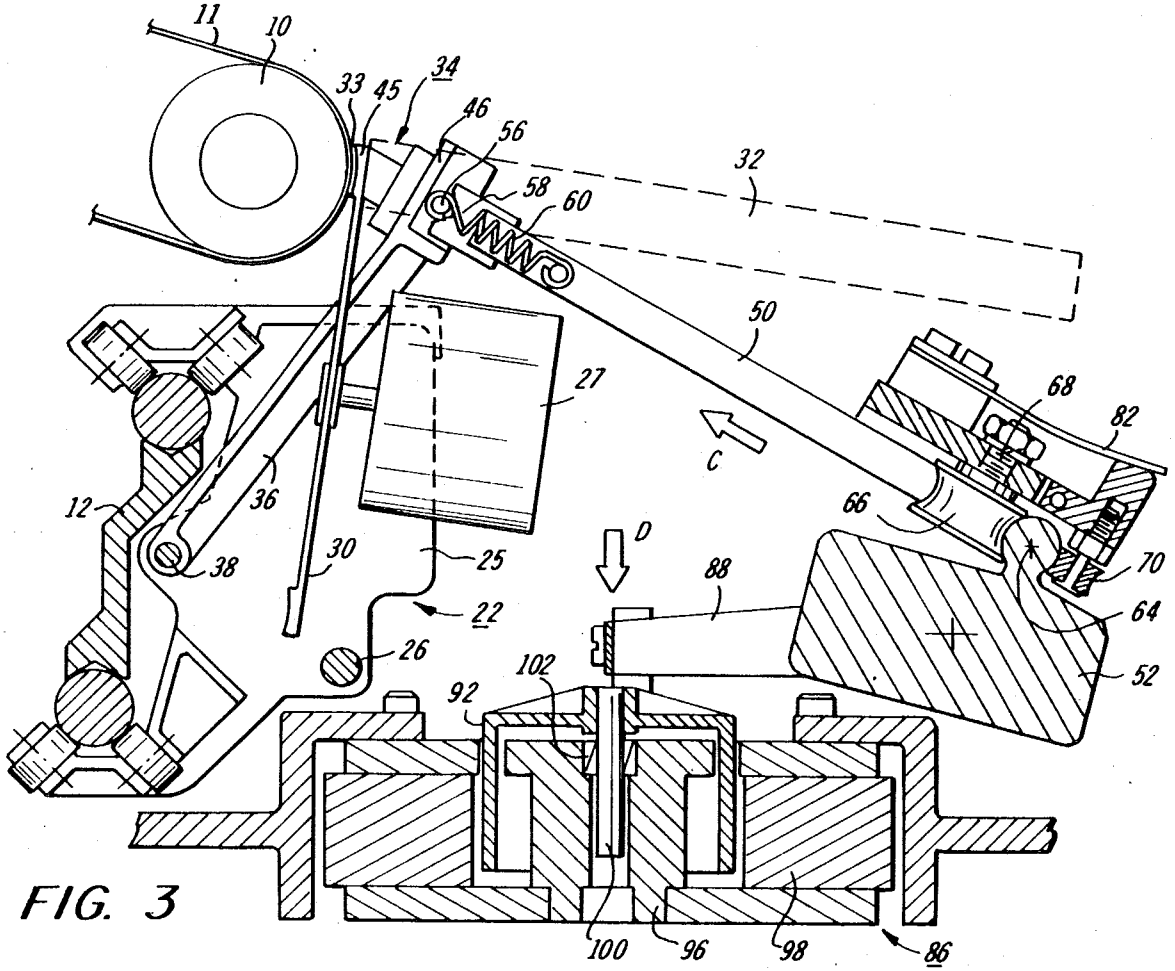
FIG. 3 is a side elevation view similar to FIG. 2 showing the print tip in a force applying position.

The novel impact printer of the present invention will be described with particular reference to FIGS. 1, 2 and 3. It includes a platen 10, comparable to those used in conventional impact printers, suitably mounted for rotation in bearings in a frame (not shown) and connected to a drive mechanism (also not shown) for advancing and retracting a sheet 11 upon which characters may be imprinted. A carriage support bar 12 spans the printer from side to side beneath the platen. It may be fabricated integrally with the base and frame or may be rigidly secured in place. The carriage support bar is formed with upper and lower V-shaped seats 14 and 16 in which rod stock rails 18 and 20 are seated and secured. In this manner, it is possible to form a carriage rail structure having a very smooth low friction surface while maintaining relatively low cost.

It is important that the support bar 12 extends parallel to the axis of the platen so that the carriage 22 and the printing elements carried thereon will be accurately located in all lateral positions of the carriage, along the length of the platen. A cantilever support arrangement for the carriage is provided by four sets of toed-in rollers 24, two at the top and two at the bottom, which ride upon the rails 18 and 20. In this manner, the carriage is unobtrusively supported for moving several motors and other control mechanisms for lateral movement relative to the platen. A suitable carriage drive arrangement (not shown) such as a conventional cable, belt or screw drive may be connected to the carriage for moving it parallel to the platen 10 upon the support bar 12, in the direction of arrow A.

The carriage 22 is shown as comprising side plate 25 secured together by connecting rods 26 and supporting the toed-in rollers outboard thereof. Although the presently preferred form is somewhat differently configured, this representation has been made merely to more easily illustrate the relationship of parts. There is shown mounted on the carriage a printwheel motor 27 having a rotatable shaft 28 to which the hub of printwheel 30 is securable. Also mounted on the carriage is a ribbon cartridge 32 (shown in phantom lines) which houses a supply of marking ribbon 33, which may be any of the types described above, and supports an exposed section thereof intermediate the printwheel and the image receptor sheet 11. A ribbon drive motor and a ribbon shifting mechanism, which are also carried on the carriage, are not shown.

In conventional printers the carriage also supports the hammer and its actuating mechanism. In the unique arrangement of the present invention, the carriage only supports a portion of the hammer mechanism, namely, a T-shaped print tip 34 secured upon an interposer member 36. The interposer is in the form of a yoke whose ends are pivotably mounted to carriage 22 on bearing pins 38 so as to be constrained for arcuate movement toward and away from the platen 10. An alternative mounting arrangement (not shown) contemplates the substitution of leaf springs for the bearing pin support to allow more degrees of freedom of movement for the interposer 36.

The print tip 34 is T-shaped, with a base 40 and a central, outwardly extending, impact portion 42 having a V-groove 44 in its striking surface. The V-groove mates with V-shaped protrusions on the rear surface of each printwheel character pad 45. Thus, upon impact, the mating V-shaped surfaces will provide fine lateral alignment for the characters by moving the flexible spokes slightly left or right, as needed, for accurate placement of the character impression upon the print line of the receptor sheet 11. The outer ends of the base 40 are secured to mounting pads 46 of the interposer 36, leaving the central portion of base unsupported.

A hammer force applying mechanism comprising a mass transformer 48 is provided for moving the print tip. It is not carried by the carriage, as are usual printer hammers. It includes a push-rod 50 and a rockable bail bar 52 which rocks about an axis 54 in the direction indicated by arrow B. A bearing pin 56 mounted on the upper end of the interposer 36, provides a seat for the V-shaped driving end 58 of the push-rod 50. The two bearing surfaces 56 and 58 are urged into intimate contact by springs 60. Thus, as the bail bar is rocked toward and away from the platen, the push-rod moves the interposer for urging the print tip 34 toward and away from the platen in the direction indicated by arrow C. At the opposite, driven end 62 of the push-rod, there is provided a resilient connection with an elongated driving surface of the bail bar 52, in the form of an integral bend 64. The bead is extends parallel to the rocking axis 54. One side of the bead provides a transverse bearing surface for a first push-rod wheel 66, journaled for rotation on a pin 68 secured to the push rod. The opposite side of the bead provides a transverse bearing surface for a second push-rod wheel 70, spring biased thereagainst, for insuring that the first wheel intimately contacts the bead. Biasing is effected by providing the driven end of the push-rod with a clevis 72 to receive the tongue 74 of pivot block 76, held in place by clevis pin 78. The second wheel 70 is supported upon bearing pin 80 anchored in the pivot block. A leaf spring 82, cantilever mounted on a block 84 urges the pivot block 76 to bias the second wheel 70 against the bead 64, for effecting intimate contact of the first push-rod wheel 66 against the bail bar bead.

Rocking of the bail bar about its axis 54 is accomplished by a prime mover, such as voice coil motor 86, securely mounted on the base of the printer. A lever arm 88 on the bail bar is secured to a flexure connector 90 mounted atop movable motor coil wound bobbin 92 on mounting formations 94. The voice coil motor includes a central magnetically permeable core 96 and a surrounding concentric magnet 98 for driving bobbin 92 axially upon support shaft 100, in the direction indicated by arrow D. Bottin 92 is guided in bushing 102 in response to current being passed through the coil windings.

In operation, upon receiving a signal to initiate an impact, current is passed through the coil would bobbin 92 in one direction for drawing it downwardly (arrow D) and for pulling lever arm 88 to rock bail bar 52 about its axis 54 (arrow B). Rocking movement of the bail bar causes bead 64 to drive push-rod 50 toward the platen 10 (arrow C). Since the push-rod is maintained in intimate contact with the interposer 36, the motion of the push-rod is transmitted to the print tip 34 which is driven along the same angular trajectory, to impact the deformable platen. As the carriage 22 is moved laterally across the printer (arrow A), by its drive arrangement, the push-rod is carried along with it, across the printer, between the interposer 36 and the bail bar 52, with driving contact being maintained by the spring biased wheels 66 and 70, straddling the bead rail. Conversely, when current is passed through the coil wound bobbin 92 in the opposite direction, it will be urged upwardly for drawing the print tip away from the platen.

It can be seen that the magnitude of the effective mass of the print tip 34, when it contacts the platen 10, is based primarily on the momentum of the heavy bail bar 52 which has been set in motion by the voice coil motor 86. The kinetic energy of the moving bail bar is transferred to the platen through the print tip, during the dwell or contact period, in which the platen is deformed and wherein it is stored as potential energy. By extending the length of the contact period and substantially increasing the effective mass of print tip, an impact noise reduction of about 1000-fold, relative to conventional impact printers, has been achieved.

Figure 4:
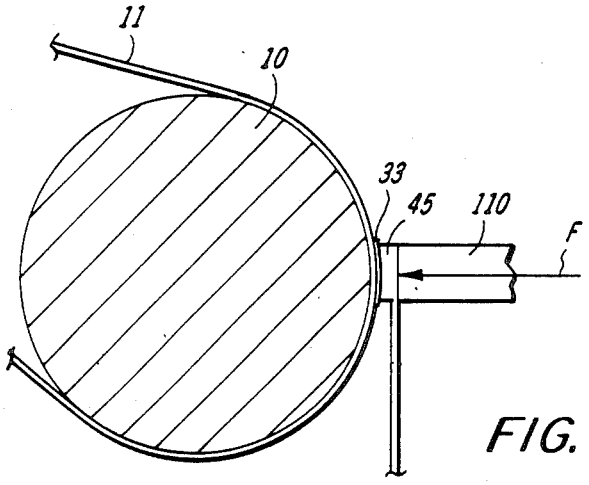
FIG. 4 is an enlarged schematic view of the prior art application of hammer impact force.

Turning now to the schematic illustrations of FIGS. 4 and 5, the force components acting upon the ribbon for releasing ink therefrom, will be discussed. FIG. 4 shows the conventional prior art hammer 110 which delivers an impact force F' to the character element 45, driving it against the marking medium 33, the paper 11 and the platen 10. The impact force trajectory, at the moment of impact, is substantially 0° relative to the radius of the platen. In some printers, the hammer traverses an arcuate path on its way to impact. However, it is irrelevant by what path the hamer reaches the impact point since by design the usual contact angle is radial (i.e. 0°).

Figure 5:
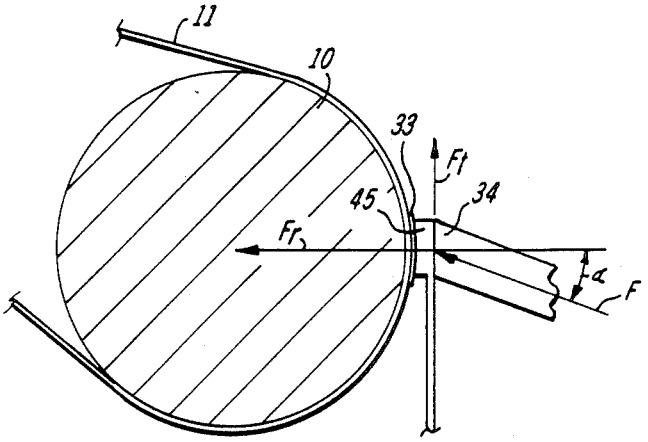
FIG. 5 is an enlarged schematic view of the oblique application of hammer impact force of the present invention.

In the present invention, as illustrated in FIG. 5, the print tip 34 delivers an impact force F to the character element 45. The line along which the print tip moves to deliver the impact force forms an angle with a line normal to the platen at the point of contact. This angle, which is identified as a, is selected to be in the range of 15° to 40°. The impact force can be resolved into a radial force component $F_r$ and a tangential, or shear, force component $F_t$. Movement of the print tip 34 in the direction of force F will urge the character element on the printwheel toward the platen while simultaneously dragging it in the tangential direction. It is the movement of the character pad and the ribbon substrate in the tangential direction, while the waxy ink coating is held stationary by the receptor paper's rough surface, which causes the ribbin substrate to move relative to the waxy coating of the single strike ribbon and to peel the fractured ink off the substrate. The same release mechanism takes place with interleaved carbon multi-part forms. In order to move the approximately 2 mils in the tangential direction for causing improved ink release, some provision must be made in the mounting arrangement of the printwheel in order to prevent the spokes from rupturing.

As has been discussed, the improved printer mechanism of the present invention is based upon the movement of a hammer mass substantially greater than that of conventional printers, and an extended hammer dwell time during which force is applied to the platen. The increased dwell time of at least 1 millisecond, and preferably 6 to 10 milliseconds, as compared to 100 microseconds in conventional printers, enhances ink release from the multi-strike, fabric and correctable ribbons because it squeezes out more of the ink.

Fortuitously, the increased ink release efficiency relative to all conventional ribbon types provides the added benefit that it enables substantially lower impact forces to be applied. Lower force will add to the sound reduction and, of course, will reduce the driving power requirements. Additionally, the overall hammer force applying mechanism will be less expensive to construct and will be easier to control since it will not have to be designed to withstand high force loads. Furthermore, the life of the printwheel will be extended since the face of the font will wear at a much slower rate.

The significant reduction in the printing force requirements contemplated by the oblique application of printing force of the present invention, is quite clear. For example, one can expect the peak energy levels normally encountered in conventional impact printers to be in the range from the high 50's to about 100 pounds, depending upon the size of the character to be printed and the type of ribbon or multi-part form. This should be compared with a peak force of about 40 pounds for the most dense impression of the largest character when impacting six-part carbonf orms in the present printer.

It has been found that the oblique angle at which the print tip impacts the character pad, relative to a radius of the platen, should be in the range of about 15° to about 40° and, more specifically, in the range of 25° to 35°. From 0° to about 15° the peak force required was too high. Then, at about 40° to 45°, the force was low enough but there was too much shear, causing smearing of the printed characters.

The placement of the hammer force applying mechanism at the desirable oblique angle yields yet another benefit, namely, print line visibilty. After the printing of each character the print tip is retracted away from the platen in adirection which drops it below the print line. This motion enables the operator to more clearly see the print line, unobstructed by the hammer mechanism.

It should be understood that the present disclosure has been made only by way of example, and that numerous changes in details of construction and the combination and arrangement of parts may be resorted to without departing from the true spirit and scope of the invention as hereinafter claimed.

What is claimed:

1. A serial impact printer including means for delivering a printing force to drive a character element in sequence against marking means, mark receiving means and a print line on a platen in order to deform said platen during a contact period, characterized in that said means for delivering comprises shear inducing impacting means and means for moving said impacting means against said character element along a line forming an angle of at least 15° and no greater than 40° to a line normal to the surface of said platen at the point of contact of said impacting means with said platen, so that a shear force is induced between said character element and said marking means during said contact period, and said impacting means causes said contact period to last for at least 1 millisecond.

2. The serial impact printer as defined in claim 1 characterized in that said means for moving and said impacting means travel in a path in which the print line is the uppermost extent thereof so that upon retraction, the visibility of said print line will be improved.

3. The serial impact printer as defined in claim 1 characterized in that said impacting means causes said contact period to last for at least 4 milliseconds.

4. The serial impact printer as defined in claim 1 characterized in that said angle is at least 20° and no greater than 35°.

5. An improved method for serial impact printing, including the steps of providing a platen, providing a mark receiving member adjacent said platen, providing a character element movable toward and away from said platen, providing a marking member intermediate said character element and said mark receiving member, and moving said character element toward and away from said platen for impacting said platen and for causing a deformation thereof during a contact period, said method characterized by comprising the steps of causing said contact period to extend for at least 1 millisecond, and inducing a shear force between said character element and said marking member, during the impact of said character element with said platen, by moving said impacting member into contact with said character element at an angle of at least 15° and no greater than 40° to a line normal to the surface of said platen at the point of contact of said impacting means with said platen.

6. The improved method for serial impact printing as set forth in claim 5 characterized in that said step of inducing a shear force is accomplished by contacting said character element with an impacting member movable along a line forming an angle with a line normal to the surface of said platen at the point where said character element causes deformation of said platen.

7. The improved method for serial impact printing as set forth in claim 5 characterized in that said step of inducing a shear force is accomplished by moving said impacting member into contact with said character element at an angle of at least 20° and no greater than 35°.

8. The improved method for serial impact printing as set forth in claim 5 characterized by causing said contact period to extend for at least 4 milliseconds.

* * * * *